US007029286B2

(12) United States Patent
Hall et al.

(10) Patent No.: US 7,029,286 B2
(45) Date of Patent: Apr. 18, 2006

(54) PLASTIC HOUSINGS FOR JACK ASSEMBLIES

(75) Inventors: John Wesley Hall, Harrisburg, PA (US); Douglas John Hardy, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 195 days.

(21) Appl. No.: 10/360,361

(22) Filed: Feb. 7, 2003

(65) Prior Publication Data

US 2004/0157498 A1 Aug. 12, 2004

(51) Int. Cl.
*H01R 12/00* (2006.01)

(52) U.S. Cl. ..... 439/63; 439/357; 439/540.1; 439/581

(58) Field of Classification Search ..... 439/540.1, 439/701, 553, 63, 357, 581, 350–356, 358
See application file for complete search history.

(56) References Cited

U.S. PATENT DOCUMENTS

| | | | | |
|---|---|---|---|---|
| 4,883,432 | A * | 11/1989 | Reed | 439/553 |
| 5,106,325 | A * | 4/1992 | Robinson et al. | 439/540.1 |
| 5,125,854 | A * | 6/1992 | Bassler et al. | 439/607 |
| 5,462,455 | A * | 10/1995 | Reichle | 439/681 |
| 5,645,454 | A * | 7/1997 | Kosmala | 439/675 |
| 5,733,146 | A * | 3/1998 | Block | 439/610 |
| 5,904,578 | A * | 5/1999 | Kubota et al. | 439/63 |
| 6,062,892 | A * | 5/2000 | Meng et al. | 439/357 |
| 6,132,233 | A * | 10/2000 | Fukuda | 439/357 |
| 6,217,377 | B1 * | 4/2001 | Nishizawa | 439/553 |

* cited by examiner

*Primary Examiner*—Gary F. Paumen

(57) ABSTRACT

An electrical connector comprising at least a one or two position FAKRA compliant jack housing providing a SMB interface and further comprising a front section keyed according to desired FAKRA specifications, and a rear section having a latch on the back of both sidewalls of the rear section; and a jack, which can integrate into said FAKRA compliant jack housing wherein said jack is snap-fit into place by the latches on the rear section.

33 Claims, 8 Drawing Sheets

PLASTIC HOUSINGS FOR JACK ASSEMBLIES

FIELD OF THE INVENTION

This invention relates to electrical connectors. More particularly, this invention relates to apparatus, methods and articles of manufacture for one and two position electrical connectors for connection to cables and printed circuit boards.

BACKGROUND OF THE INVENTION

Cable to cable connectors and printed circuit board (PCB) to cable connectors may be standardized according to various schemes. One standardization scheme commonly used in automotive applications is referred to as FAKRA. FAKRA, a standardization group, is a German word that stands for Normenausschuβ Kraftfahrzeuge with an English translation known as "Automotive Standards Committee in the German Institute for Standardization." FAKRA released DIN 72594, the German version of the standardization scheme related to this application. DIN 72594 is related to the proposal entitled "ISO TC 22/WG 5 N 44-Road vehicles-Radio frequency interface-Dimensions and electrical requirements." This standardization scheme promulgated by FAKRA is known to and referred in the art as FAKRA standardization, owing to the name of the organization who developed the standardization scheme.

The FAKRA standardization scheme establishes how a jack housing must be configured in order to provide proper keying for integration into an appropriate plug, and at the same time allow for the connection of a desired SMB jack into the jack housing, which has the appropriate SMB interface.

The FAKRA standardization scheme provides specific key and color-codes for desired SMB interfaces. The FAKRA code provides eleven specific key and color-codes for one-position SMB interface connections. This current FAKRA standard is also referred to herein as a "predetermined coding scheme." These eleven specific key and color-codes provide eleven specified arrangements of ribs and recesses on jack housings that mate with complementary plugs.

The FAKRA standardization scheme also provides eight specific key and color-codes for two position SMB interface connections. This current FAKRA standard is also referred to herein as a "predetermined coding scheme." These eight specific key and color-codes provide specified arrangements of ribs and recesses on jack housings that mate with complimentary plugs.

Both one and two position FAKRA standardized jack housings must retain compliance with FAKRA specifications, while also providing the proper SMB interface. For example, a two-position FAKRA standardized jack housing must have the proper SMB interfaces for the corresponding SMB jacks. As a result of the FAKRA standards, any improvement of a specific FAKRA compliant connector must be carefully done so as not to interfere with the FAKRA specified arrangement for that connector.

Despite the success of the FAKRA standardization scheme, improvement is desirable in SMB jack connections to one and two position FAKRA standardized jack housing and the resulting FAKRA-SMB assembly's connection to a complementary plug. For example, the SMB interface(s), contained in the FAKRA standardized jack housing, maintain contact with a corresponding SMB jack so as to provide proper audible and tactile feedback.

SMB jack connections to the FAKRA standardized jack housing must also be flexible within certain applications that place physical and temperature stress on the connection. For example, a FAKRA-SMB assembly used in an automotive application must maintain contact, while at the same time, not maintain the contact in such a rigid manner so as break or become disconnected when encountering the inevitable stress placed on an automotive application.

The present invention was developed in view of the foregoing to overcome the deficiencies of the prior art.

SUMMARY OF THE INVENTION

The present invention discloses an improved connector system with an improved jack housing connection to a jack and an improved jack housing-jack assembly connection to a corresponding plug. Embodiments are used in either one or two position jack housings and jacks, in either single or multi-position cable assemblies, for connecting the jack housings and jacks contained therein to either a printed circuit board or to a cable.

DETAILED DESCRIPTION OF THE PREFERRED EMBODIMENTS

The components of one embodiment of the present invention comprises either a one or two position FAKRA standardized jack housing, wherein the FAKRA standardized jack housing is comprised of a front and a rear section. In this embodiment, the front section of the housing is configured so as to maintain FAKRA standardization for each desired key. For example, a two-position FAKRA housing may have separate FAKRA keys for separate plugs. The rear section of the FAKRA standardized jack housing provides a connection means for SMB jack(s). The rear section of the FAKRA standardized jack housing has latches on the back of both sidewalls.

The SMB jack is comprised of a subassembly contact integrated into a rear shell. The SMB jack(s) are snapped into the rear section of the FAKRA standardized jack housing(s) and secured into place by latches, which are on the rear section of the jack housing. The SMB jack is locked and engaged with the FAKRA standardized jack housing when properly contacted to the FAKRA standardized jack housing's SMB interface.

The SMB jack is secured into the FAKRA housing when two latches from the rear section of the housing snap-fit around the back of the SMB jack's rear shell. This allows the subassembly contact to remain engaged with the FAKRA standardized jack housing's SMB interface.

Another feature of an embodiment of the present invention is a web that connects the two front sections of a two-position FAKRA standardized jack housing. The web provides added stability to the connector and helps the front sections maintain a symmetrical and parallel relationship to one another. The web is inserted into a slot of the plug, and securely locked into position with the locking nose of the two-position FAKRA-SMB assembly, which mates with the plug's lock hatch.

Yet another embodiment of this invention and its latching feature is the ability to remove a SMB jack from the FAKRA standardized jack housing after the SMB jack has been latched into place. For example, this would allow for the removal and replacement of an SMB jack that was defective, in need of repair or lacking the necessary contact.

Still another embodiment of the present invention, as it relates to two-position FAKRA standardized jack housings, are the front sections, which have two separate keying mechanism. The two front sections of the FAKRA standardized jack housings, which are conjoined by the web (earlier described), have different keying for connection to appropriate plugs.

Figure 1:
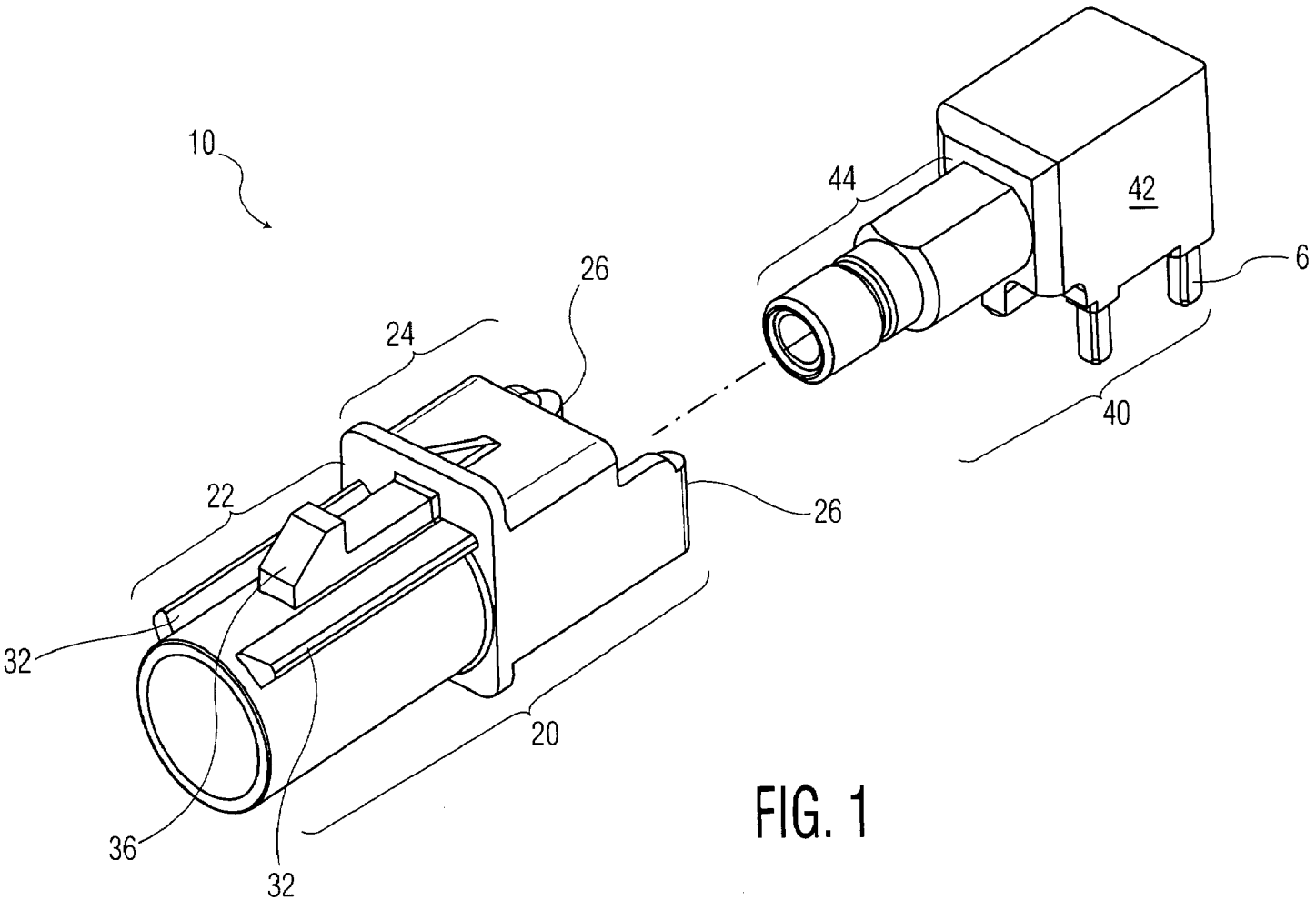
FIG. 1 is a planar view of jack housing and jack.

Now, with reference to the drawings in detail, wherein like reference numerals indicate like elements throughout the several views, there is illustrated in FIG. 1 an embodiment of a connector, shown generally at 10, having right angle printed circuit board (PCB) contacts 6. The figure generally shows an elevational view of an unmated jack housing 20 (a jack housing with a FAKRA standardized connector), and a jack 40 (SMB jack). Front section 22 of the jack housing 20 is configured as desired, i.e. according to the desired FAKRA code. Thus, front section 22 may take on a number of desired FAKRA keying configurations. Rear section 24 of the jack housing 20 provides the appropriate opening for its corresponding jack 40. Front section 22 is a generally tubular member extending from the rear section 24 of jack housing 20. In this embodiment, the front section 22 has keys 32 which generally run the length of the front section 22 and are substantially triangular elements. Front section 22 also has a locking nose 36, which has a substantially sloped face with a flat top portion that drops off perpendicular to a rectangular piece running into the rear section 24 of the jack housing 20.

In this exemplary embodiment, rear section 24 has two latches 26, which snap-fit around the rear shell 42 of jack 40, when the jack 40 is integrated into jack housing 20. The rear shell 42 is a substantially cube member which gaplessly connects to and contains a subassembly contact 44. The latches 26 expand outward as they are brought over the rear shell 42, and when jack 40 is properly integrated into jack housing 20 the latches constrict inward around the rear shell 42, thus securing jack 40 into jack housing 20. Subassembly contact 44 is configured so as to provide for a proper contact with the SMB interface 28 of FIGS. 4 and 6 which are contained within jack housing 20. In this embodiment, sub-assembly contact 44 extends from the rear shell 42 of jack 40, and is shaped generally tubular having an aperture in its front end and a partially squared-off rear end. When integrated, the jack housing 20 retains jack 40, and allows for the flex of the jack housing-jack assembly, while maintaining jack 40 to SMB interface 28 contact.

Figure 2:
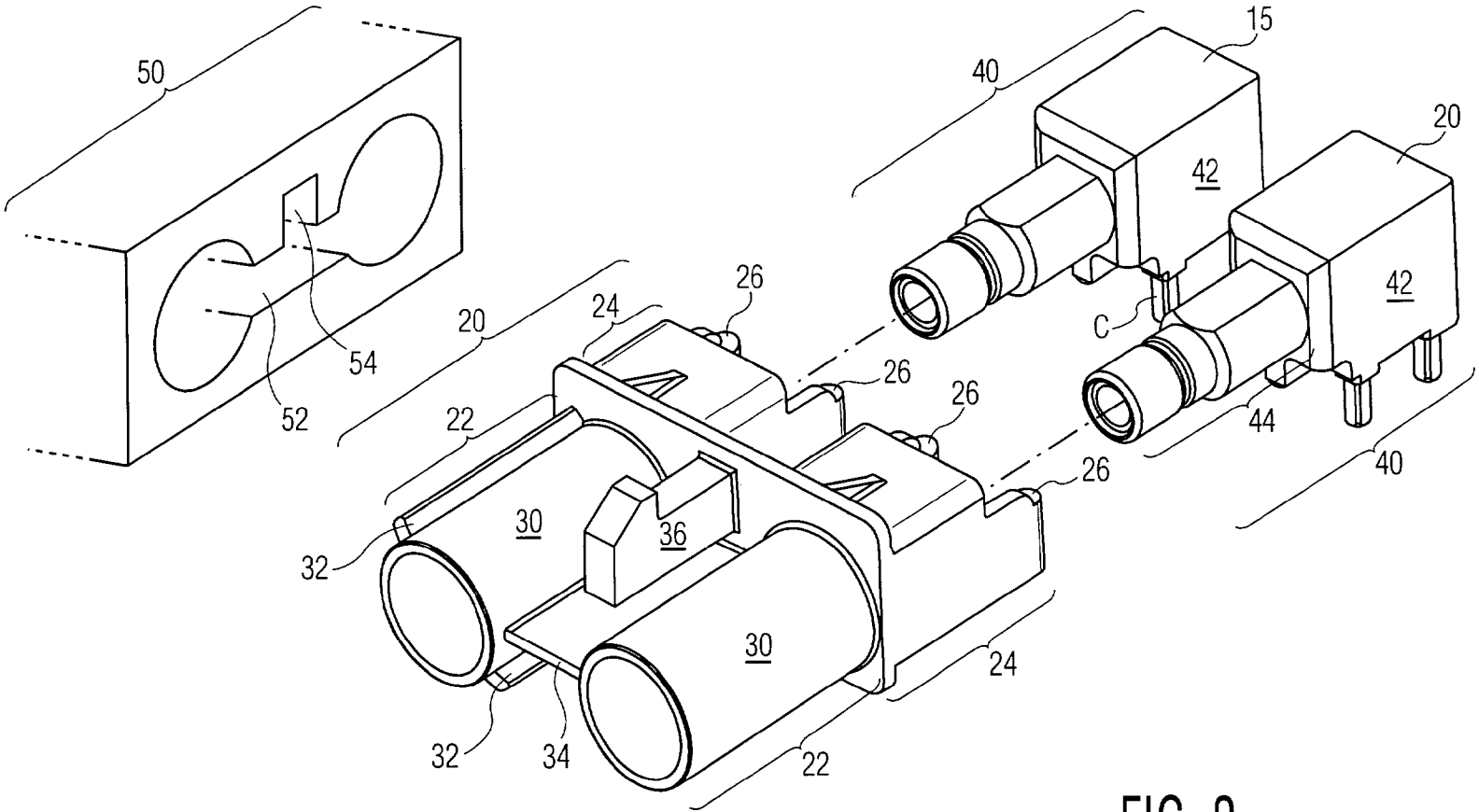
FIG. 2 is a planar view of a two-position jack housing and two jacks.

Turning now to FIG. 2, an planar view of a two-position connector is shown, with two jacks 40 and a two-position jack housing 20. The front section 22 has two barrels 30 keyed according to FAKRA specification. One of the two barrels 30 has keys 32, while the other barrel, also in accord with FAKRA specifications, is smooth. There are eight different keying positions for two position FAKRA compliant connectors in this embodiment. Front section 22 further comprises a web 34 connecting the two barrels 30 to provide for structural support between the two barrels 30. The web 34 is a generally flat piece extending outward from the rear section 24 of jack housing 20 and connected along the exterior of barrels 30. Situated centrally on top of web 34 is locking nose 36. In this embodiment, locking nose 36 is shaped as described in FIG. 1, and the locking nose 36 is positioned centrally on web 34. Web 34 and locking nose 36 can be stably integrated into a plug 50.

The rear sections 24 further comprise four latches 26 in this embodiment. The latches 26 snap-fit around the back of the two rear shells 42 of the two jacks 40.

It should be noted that the term "snap-fit" as used herein provides for snap-in and snap-out of the jack 40. That is, installation of the jack 40 is not permanent, but rather the two jacks 40 can be removed by pulling apart latches snapped around the back of the rear shells 42.

FIG. 2 further shows plug 50, with slot 52 and locking hatch 54, which allows for stable integration of an assembled jack housing 20 and jack 40. The plug 50 is configured to accommodate and integrate with appropriate FAKRA keys. Web 34 integrates into slot 52 and locking nose 36 is locked into position in locking hatch 54 to provide and maintain contact. The two barrels 30 are keyed according to a desired FAKRA code to stably integrate into the plug 50.

Figure 3:
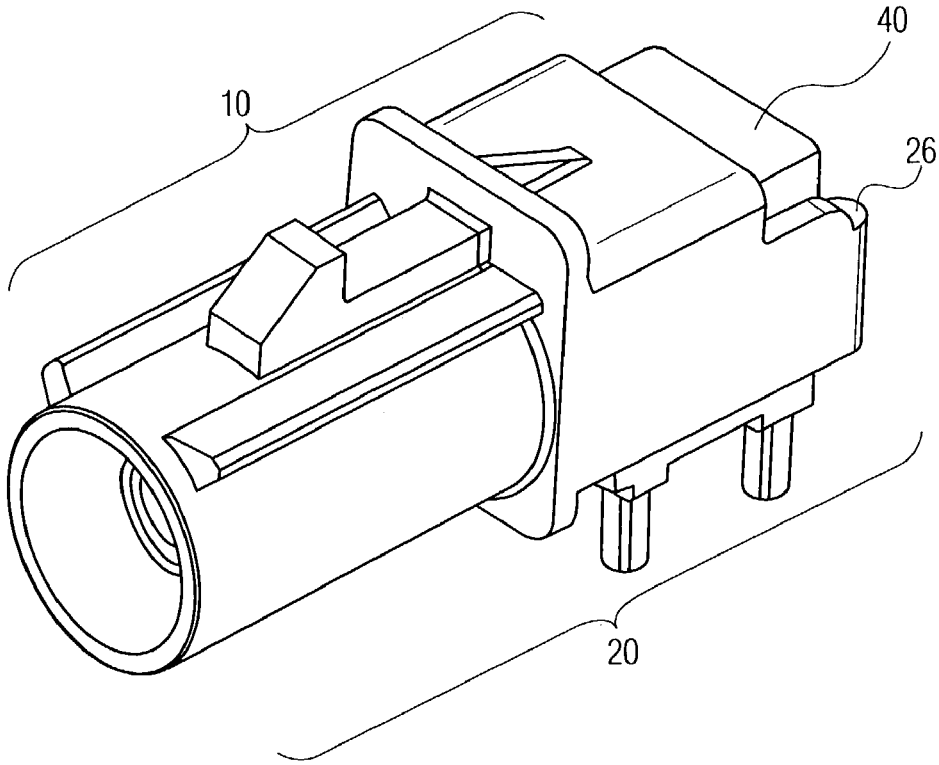
FIG. 3 is a planar view of a one-position assembled connector.

Turning now to FIG. 3, an assembled connector 10 is shown, wherein the jack 40 is stably integrated into the jack housing 20. In this embodiment, the overlap of rear section 24 over the rear shell 42 of jack 40 is illustrated. The latches 26 have an inward flap which snaps around the back of jack 40, preventing the jack 40 from becoming damaged from the jack housing 20.

Figure 4:
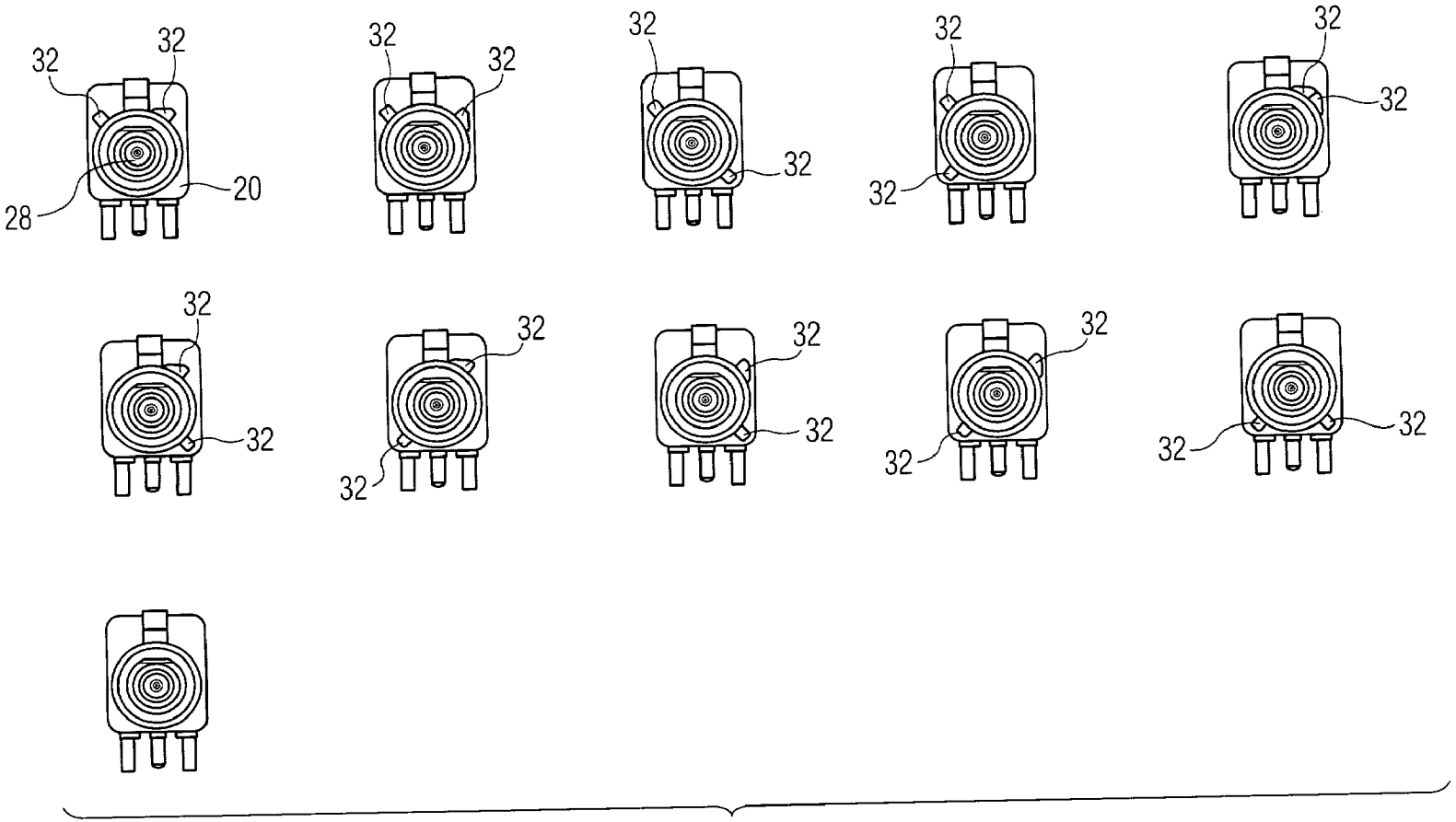
FIG. 4 is a sectional view of a one-position assembled connector taken along the V—V cross-sectional plane of FIG. 3 and illustrating eleven different keying positions for the one-position connector.

FIG. 4 shows an embodiment having eleven keying positions for the keys 32 of a single position FAKRA connector. FIG. 4 also shows an embodiment of the SMB interface 28 contained within each of the jack housings 20.

Figure 5:
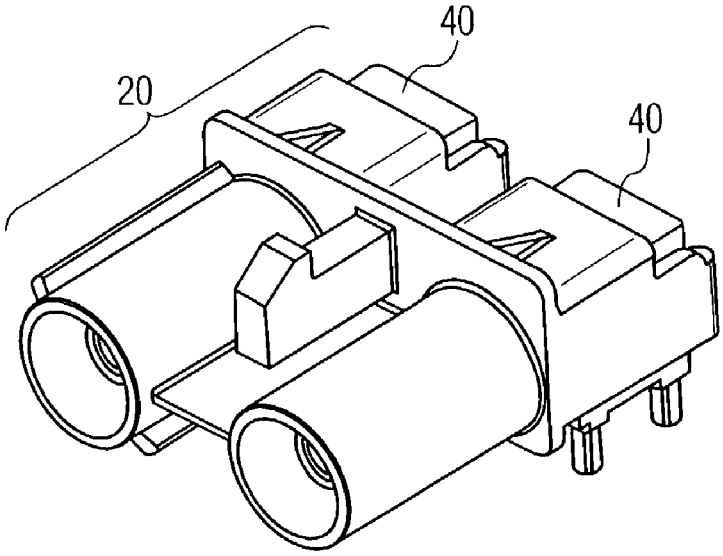
FIG. 5 is a planar view of a two-position assembled connector.

FIG. 5 shows a two-position jack housing 20 mated with two jacks 40, wherein the two jacks 40 are stably integrated into jack housing 20. Each individual jack 40 can be removed and inserted separately from the other jack 40. The mating between jacks 40 and jack housing 20 is the same as was described in FIG. 3.

Figure 6:
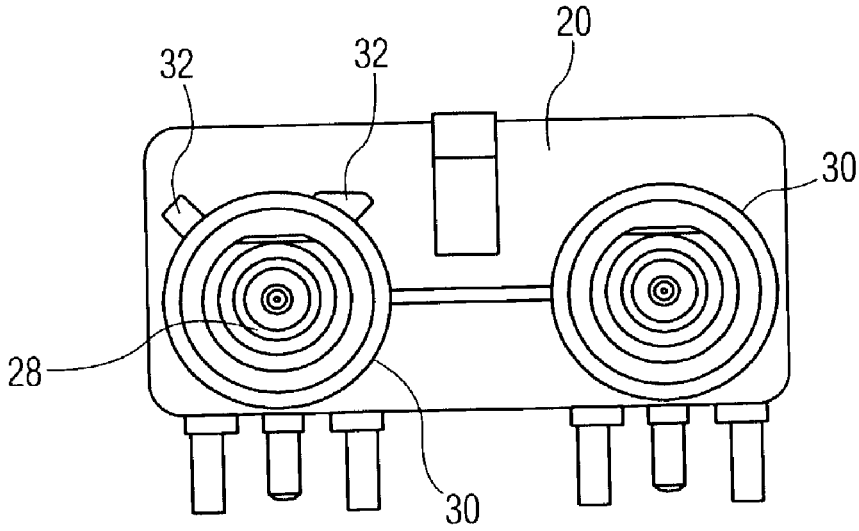
FIG. 6 is a sectional view of a two-position assembled connector taken along the V—V cross-sectional plane of FIG. 5 and illustrating one of eight different keying positions for the two-position connector.

FIG. 6 shows one of eight keying positions for the keys 32 of a two-position FAKRA connector. It should be noted that in this embodiment, all eight keying configurations illustrate that one of the two barrels 30, is smooth. FIG. 6 also shows the SMB interface 28 that is contained within each of the jack housings 20.

Figure 7A:
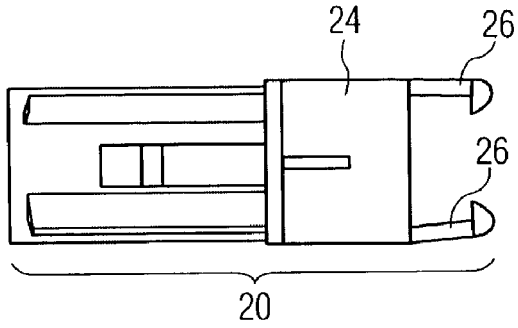
FIG. 7 is an overhead and side view of a one-position jack housing.
Figure 7B:
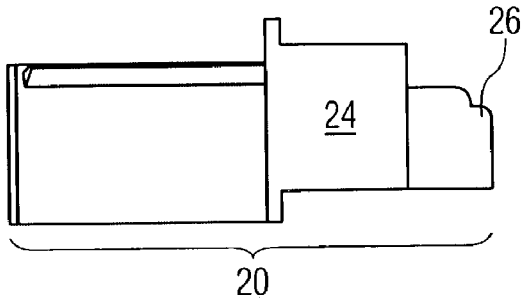

FIG. 7 shows an overhead (A) and side view (B) of a single position jack housing 20, with two latches 26 on the back of the rear section 24. FIG. 7 illustrates latches 26; which have a partial inward flex, prior to mating with jack 40. The inward tension helps to secure jack 40, when it is integrated into the jack housing 20.

Figure 8A:
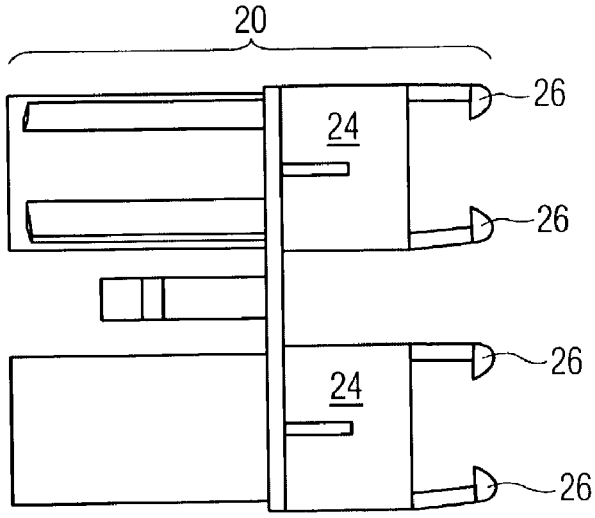
FIG. 8 is an overhead and side view of a two-position jack housing.
Figure 8B:
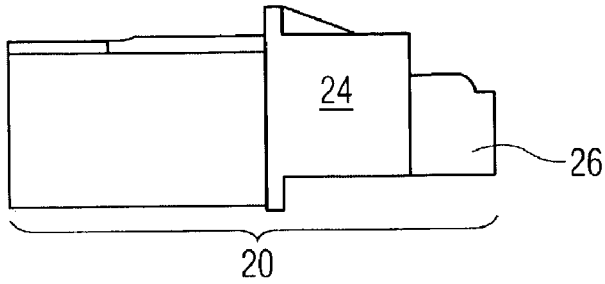

FIG. 8 shows an overhead (A) and side view (B) of a two position jack housing 10, with four latches 26 on the back of two rear sections 24. FIG. 8 illustrates latches 26 have a partial inward flex, prior to mating with jack 40. The inward tension helps to secure jack 40, when it is integrated into the jack housing 20.

Figure 9A:
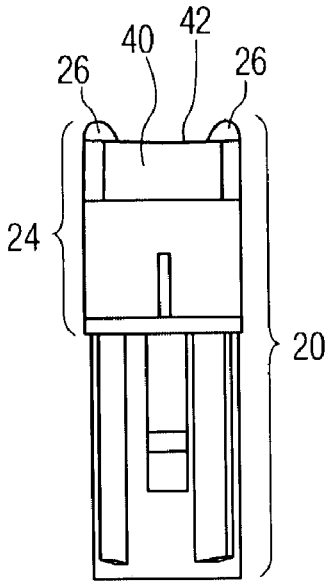
FIG. 9 is an overhead and side view of a one-position assembled connector.
Figure 9B:
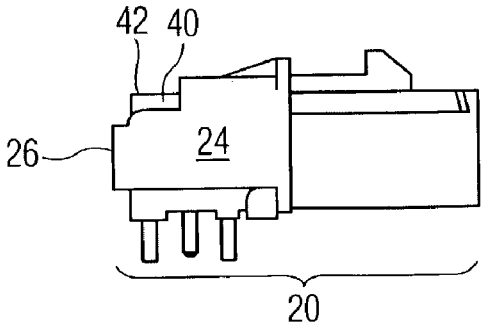

FIG. 9 shows an overhead (A) and side view (B) of an assembled connector, having one jack 40 fully engaged into jack housing 20, with two latches 26 snap-fit around the rear shell 42 of the jack 40. The latches 26 flex outward as the jack 40 is integrated, and once jack 40 is fully mated the latches 26 are snapped around the rear shell 40.

Figure 10:
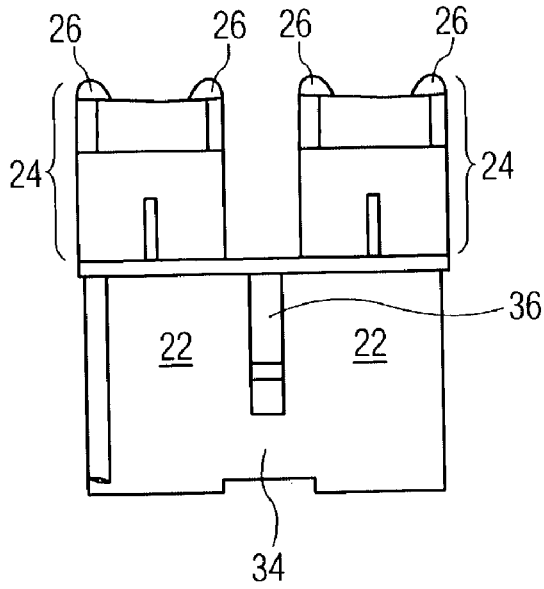
FIG. 10 is an overhead and side view of a two-position assembled connector.

FIG. 10 shows an overhead view of an assembled connector, having two jacks 40 fully engaged into jack housing 20, with four latches 26 and web 34 connecting the two front sections 22. The locking nose 36 on web 24 can be integrated into the locking hatch 54 of FIG. 2. The web 34 is substantially the same length as the front section 22.

Figure 11:
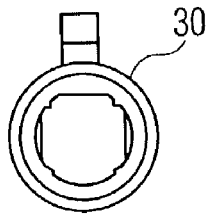
FIG. 11 is a cross-sectional view of a one-position jack housing.

FIG. 11 shows the cross section view of the barrel 30 of a jack housing 20.

Figure 12:
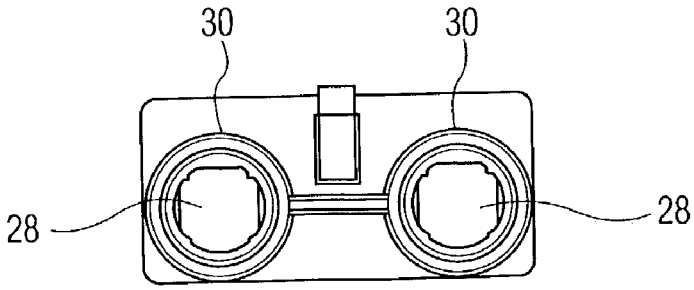
FIG. 12 is a cross-sectional view of a two-position jack housing.

FIG. 12 shows the cross section of the two barrels 30 of a two-position jack housing 20.

In other embodiments a straight-line sub-connector may be used in place of a right angle jack as illustrated in FIGS. 1 and 6.

The various elements are made of materials, such that are known in the art. For example, an embodiment of the present invention may be constructed from polybutylene terephthalate (PBT) or other similar materials. Additionally, as a non-limiting example, the conductive elements, which include the SMB interface 28, subassembly contact 44 and PCB contacts are made of a conductive element such as, for example, copper.

The above description and the views and materials depicted by the figures are for purposes of illustration only and are not intended to be, and should not be construed as, limitations on the invention.

Moreover, certain modifications or alternatives may suggest themselves to those skilled in the art upon reading of this specification, all of which are intended to be within the spirit and scope of the present invention as defined in the attached claims.

What is claimed is:

1. A coaxial electrical connector comprising:

a one or more position FAKRA compliant jack housing providing a SMB interface and further comprising a front section keyed according to desired FAKRA specifications, and a rear section having a jack receiving cavity defined by opposing sidewalls, at least one pair of opposing latches in association with the opposing sidewalls of said rear section; and a coaxial jack received within said jack receiving cavity of said FAKRA compliant jack housing wherein said jack is snap-fit to the jack housing by the at least one pair of opposing latches associated with said rear section, wherein the snap-fit provides a snap-out engagement between the jack and the jack housing.

2. The electrical connector of claim 1, wherein the jack further comprises:

a subassembly contact configured to provide contact to a desired SMB interface;

a rear shell, housing the subassembly contact and configured to provide a snap-fit to the jack housing for a snap-out engagement with the opposing latches of said rear section of said jack housing.

3. The electrical connector of claim 1, wherein the jack can be removed after it has been snap-fit into the FAKRA compliant jack housing by displacing each pair of opposing latches with respect to each other.

4. The electrical connector of claim 1, wherein snap-fitting the jack to the jack housing further comprises the initial displacement of the opposing latches with respect to each other when the jack and the jack housing are removably engaged.

5. The electrical connector of claim 1, further comprising removing the jack from being engaged with the jack housing.

6. The electrical connector of claim 5, wherein the at least one pair of opposing latches are initially displaced with respect to each other when the jack is removed from being engaged with the jack housing.

7. The electrical connector of claim 6, wherein the at least one pair of opposing latches return to substantially the same position relative to each other after the jack has been removed from the FAKRA compliant jack housing.

8. The electrical connector of claim 1, wherein the at least one pair of opposing latches are angled toward each other.

9. The electrical connector of claim 1, wherein the terminal end of a latch is angled with respect to the shaft of the latch.

10. The electrical connector of claim 9, wherein the terminal end of a latch is oriented toward an opposing latch.

11. The electrical connector of claim 1, further comprising a locking nose centrally mounted on the surface of said front section.

12. The electrical connector of claim 11, wherein the locking nose is stably integrated into a plug that is configured according to desired FAKRA standards.

13. A two position coaxial electrical connector comprising:

a two position FAKRA compliant jack housing providing a SMB interface, and further comprising two front sections keyed according to desired FAKRA specifications, and two rear sections each having opposing sidewalls and at least one pair of opposing latches associated with the sidewalls of said rear sections;

a coaxial jack, which can integrate into said FAKRA compliant jack housing and wherein said jack is snap-fit into place by said at least one pair of opposing latches associated with said rear sections, wherein the snap-fit provides a removable engagement between the jack and the jack housing;

a web conjoining the two front sections, wherein the web is a structural member for maintaining a displacement between the two front sections; and a locking nose centrally mounted on the surface of said web.

14. The two position electrical connector of claim 13, wherein both the web and locking nose are stably integrated into a plug that is configured according to desired FAKRA standards.

15. The two position electrical connector of claim 13, wherein the length of the web is substantially similar to the height of the front section.

16. The electrical connector of claim 13, wherein the jack can be removed after it has been snap-fit into the FAKRA compliant jack housing by displacing each pair of opposing latches with respect to each other.

17. The two position electrical connector of claim 16, wherein the at least one pair of latches return to substantially the same position relative to each other after the jack has been removed from the FAKRA compliant jack housing.

18. A coaxial electrical connector comprising:

a FAKRA compliant jack housing providing an SMB interface and configured to receive a coaxial jack therein, said FAKRA compliant jack housing further comprising a front section keyed according to desired FAKRA specifications, a locking nose centrally mounted on the surface of said front section, and a rear section having opposing sidewalls and at least one pair of opposing latches in association with the opposing sidewalls of said rear section for providing a snap-out engagement between the jack housing and the jack.

19. The electrical connector of claim 18, wherein the FAKRA compliant jack housing is a one or more position jack housing.

20. The electrical connector of claim 18, wherein the locking nose is stably integrated into a plug that is configured according to desired FAKRA standards.

21. The electrical connector of claim 18, further comprising a jack, which can integrate into said FAKRA compliant jack housing wherein said jack is snap-fit to the jack housing by the at least one pair of opposing latches associated with said rear section, wherein the snap-fit provides a snap-out engagement between the jack and the jack housing.

22. The electrical connector of claim 21, wherein the jack can be removed after it has been snap-fit into the FAKRA compliant jack housing by displacing each pair of opposing latches with respect to each other.

23. The electrical connector of claim 22, wherein the at least one pair of latches return to substantially the same position relative to each other after the jack has been removed from the FAKRA compliant jack housing.

24. A coaxial electrical connector comprising:

a FAKRA compliant jack housing providing a SMB interface and configured to receive a coaxial jack therein, said FAKRA compliant jack housing further comprising a front section keyed according to desired FAKIR specifications, and a rear section having opposing sidewalls, at least one pair of opposing latches in association with the opposing sidewalls, wherein the at least one pair of opposing latches are angled toward each other for a snap-out engagement of the jack housing with the jack.

25. The electrical connector of claim 24, wherein the terminal end of a latch is angled with respect to the shaft of the latch.

26. The electrical connector of claim 24, wherein the terminal end of a latch is oriented toward an opposing latch.

27. The electrical connector of claim 24, wherein the FAKRA compliant jack housing is a one or more position jack housing.

28. The electrical connector of claim 24, further comprising a structural rib integrated on the surface of said rear section.

29. The electrical connector of claim 24, further comprising a locking nose centrally mounted on the surface of said front section.

30. The electrical connector of claim 29, wherein the locking nose is stably integrated into a plug that is configured according to desired FAKRA standards.

31. The electrical connector of claim 24, further comprising a jack, which can integrate into said FAKRA compliant jack housing wherein said jack is snap-fit to the jack housing by the at least one pair of opposing latches associated with said rear section, wherein the snap-fit provides a snap-out engagement between the jack and the jack housing.

32. The electrical connector of claim 31, wherein the jack can be removed after it has been snap-fit into the FAKRA compliant jack housing by displacing each pair of opposing latches with respect to each other.

33. The electrical connector of claim 31, wherein the at least one pair of latches return to substantially the same position relative to each other after the jack has been removed from the FAKRA compliant jack housing.

* * * * *